United States Patent [19]

Austin et al.

[11] Patent Number: 4,903,880

[45] Date of Patent: Feb. 27, 1990

[54] SIDE LOAD MAGAZINE FOR A FASTENER DRIVING TOOL

[75] Inventors: Ronald Austin, Hazelcrest; Dale M. Flowers, Prospect Heights, both of Ill.

[73] Assignee: Duo-Fast Corporation, Franklin Park, Ill.

[21] Appl. No.: 250,311

[22] Filed: Sep. 28, 1988

Related U.S. Application Data

[63] Continuation-in-part of Ser. No. 63,416, Jun. 18, 1987, Pat. No. 4,801,062.

[51] Int. Cl.[4] ..... B25C 5/13; B25C 7/00

[52] U.S. Cl. ..... 227/8; 227/120; 227/128

[58] Field of Search ..... 227/126, 8, 120, 156, 227/128, 125

[56] References Cited

U.S. PATENT DOCUMENTS

| | | | |
|---|---|---|---|
| 1,634,840 | 7/1927 | Maynard | 227/126 |
| 2,368,552 | 1/1945 | La Place | 227/120 |
| 2,792,571 | 5/1957 | Klopstock | 227/120 |
| 2,954,561 | 10/1960 | Starr | 227/120 X |
| 3,041,614 | 7/1962 | D'Haem et al. | 227/120 X |
| 3,437,250 | 2/1969 | Fiedler | 227/127 |
| 3,633,811 | 1/1972 | Ploen | 227/120 X |
| 3,905,535 | 9/1975 | Novak et al. | 227/120 |
| 3,946,927 | 3/1976 | Fehrs | 227/126 |
| 4,304,349 | 12/1981 | Novak et al. | 227/109 |
| 4,389,012 | 6/1983 | Girkis et al. | 227/156 X |
| 4,597,517 | 7/1986 | Wagdy | 227/125 X |
| 4,624,401 | 11/1986 | Gassner et al. | 227/125 |

FOREIGN PATENT DOCUMENTS

| | | | |
|---|---|---|---|
| 1188009 | 2/1965 | Fed. Rep. of Germany . | |
| 1478916 | 6/1969 | Fed. Rep. of Germany | 227/128 |
| 52-13182 | 2/1977 | Japan . | |

*Primary Examiner*—Paul A. Bell

*Attorney, Agent, or Firm*—Mason, Kolehmainen, Rathburn & Wyss

[57] ABSTRACT

A magazine assembly for a fastener driving tool has an elongated fastener carrier defining a fastener feed path. The carrier is pivotally mounted about an axis parallel to the fastener feed path for movement between an operative, refill and an unjam position. In the operative position, the elongated carrier is latched by a latch assembly disposed in the forward portion of the tool. A pusher advances the fasteners forward to a nosepiece assembly. In one embodiment, retraction of the pusher releases the latch allowing the elongated carrier to pivot about an axis parallel to the fastener feed path under the influence of a spring to the refill position. In an alternate embodiment, the latch assembly is provided at the rear of the tool and is not interlocked with the pusher. A nosepiece assembly, secured to the forward end of the tool, defines a fastener drive track for guiding fasteners driven into a workpiece. The nosepiece assembly includes a front nosepiece and a rear nosepiece pivotably connected together to allow freeing of jammed fasteners. The front and rear nosepieces are provided with interlocking portions to prevent separation of the drive track during operation.

20 Claims, 6 Drawing Sheets

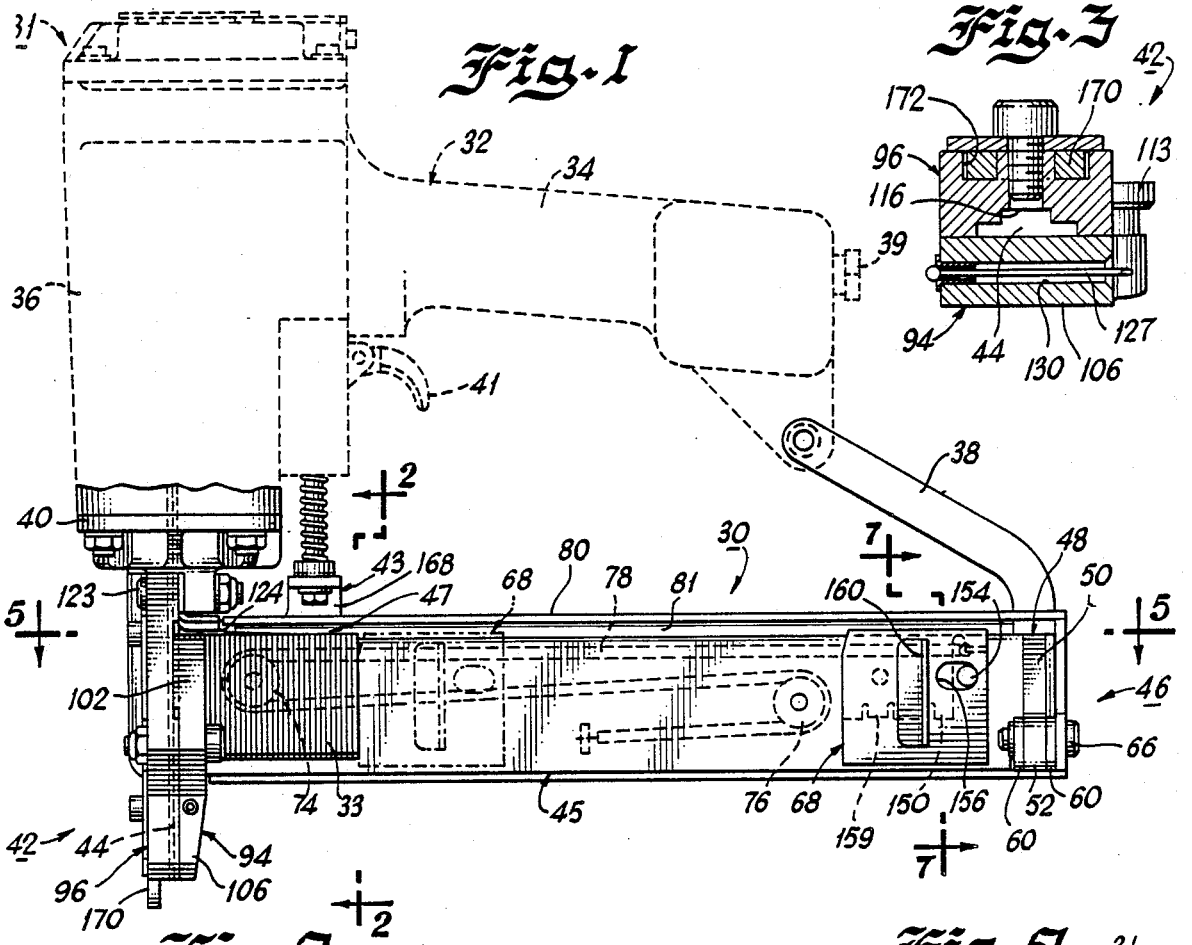
Fig. 1
31
32
34
36
39
41
38
40
2
43
168
47
123
124
5
102
68
80
78
81
30
7
160
154
48
50
46
66
74
33
45
76
150
156
52
60
159
42
44
94
96
106
170
Fig. 3
42
172
170
96
113
116
94
44
130
106
127
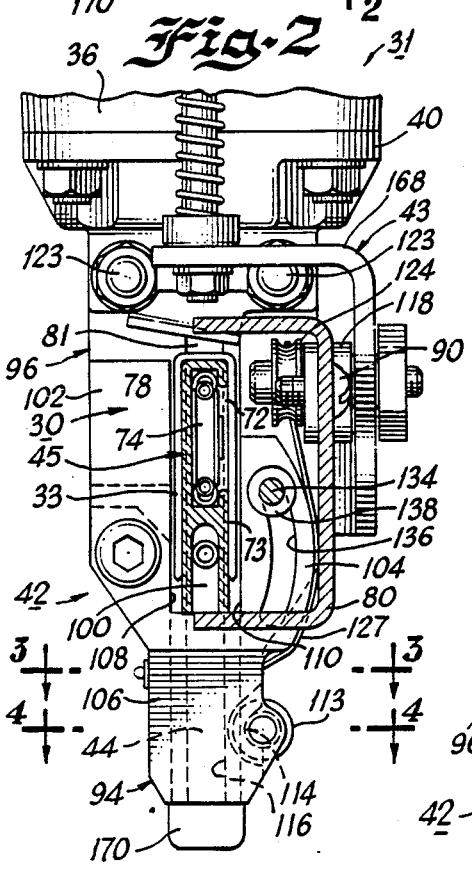
Fig. 2
31
36
40
168
43
123
124
118
81
90
96
102
78
30
72
74
45
33
134
138
136
73
104
42
80
100
127
3
108
110
106
113
4
44
94
114
116
170
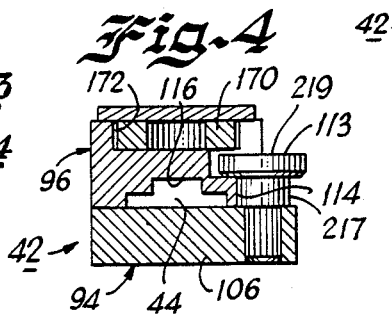
Fig. 4
172
116
170
219
113
96
114
217
42
94
44
106
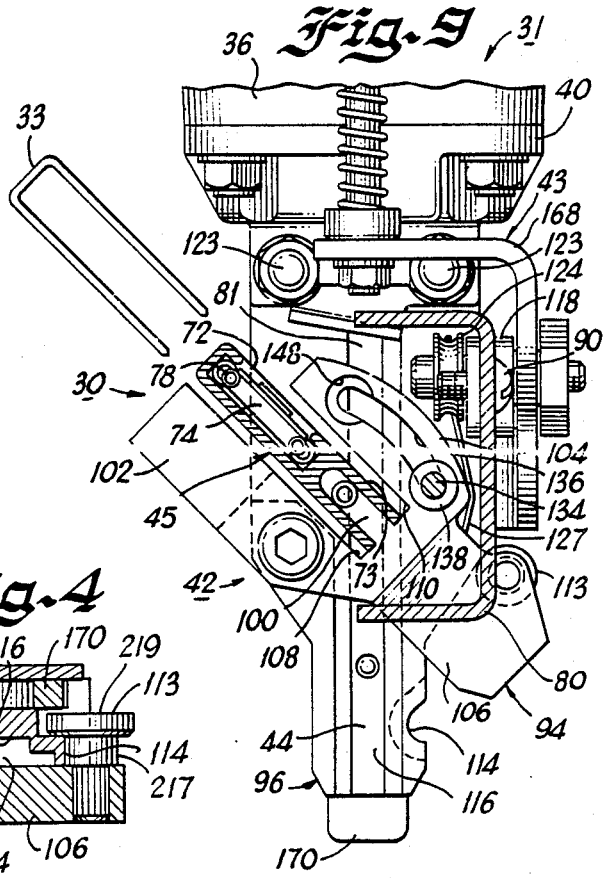
Fig. 9
31
36
40
33
43
168
123
124
118
81
90
72
148
30
78
74
102
104
136
45
134
127
138
73
110
113
42
100
108
80
106
94
44
114
96
116
170

Fig. 24
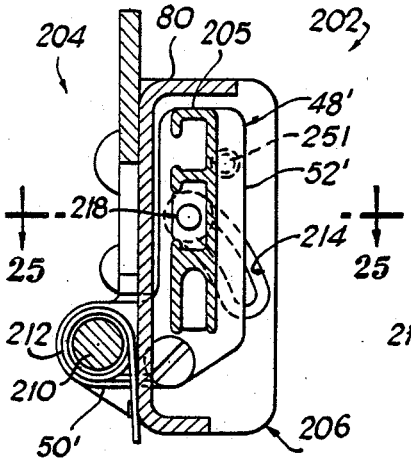
Fig. 28
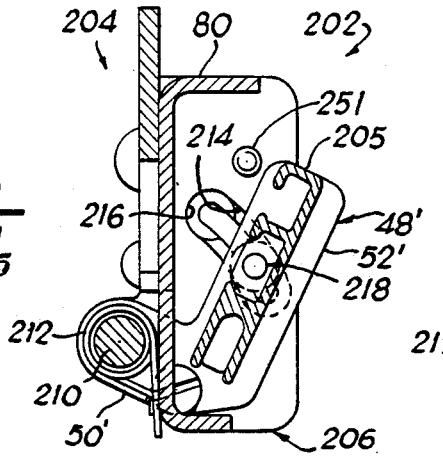
Fig. 30
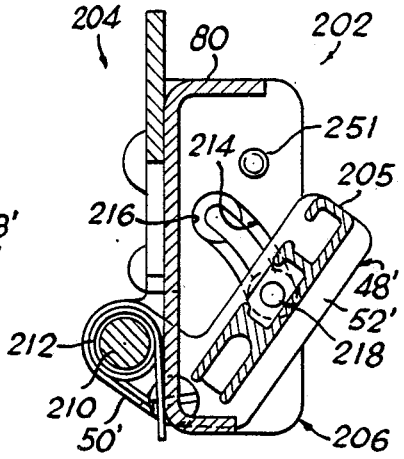
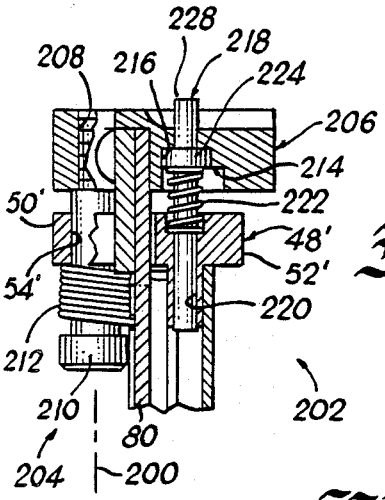
Fig. 25
Fig. 29
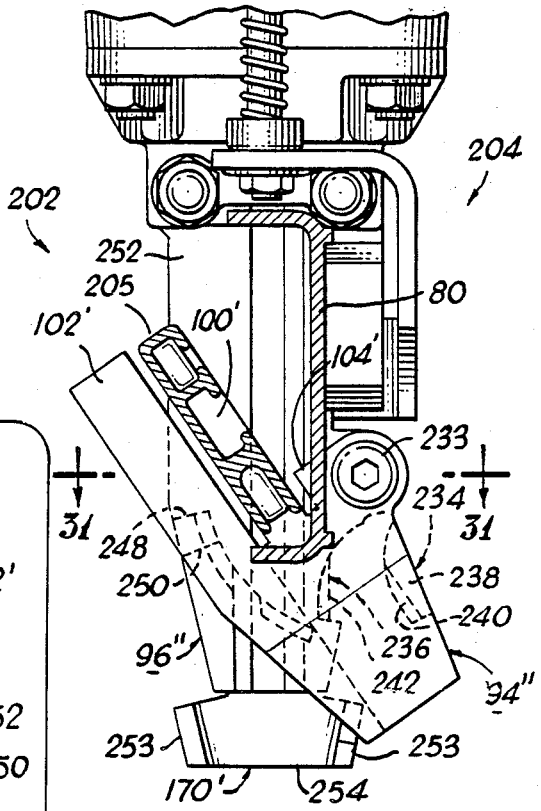
Fig. 26
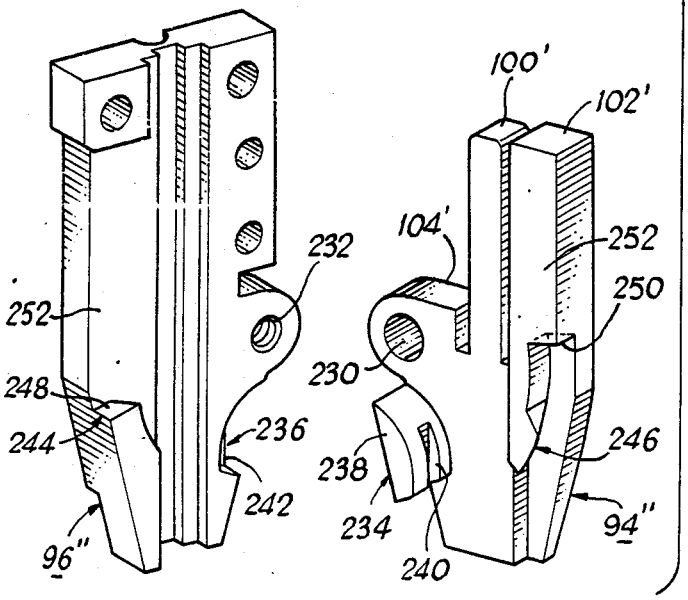
Fig. 31
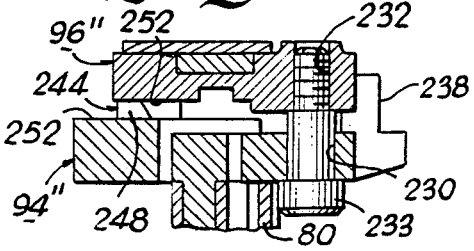

SIDE LOAD MAGAZINE FOR A FASTENER DRIVING TOOL

CROSS REFERENCE TO RELATED APPLICATIONS

This application is a continuation-in-part of copending application Ser. No. 07/063,416, filed on June 18, 1987, now U.S. Pat. No. 4,801,062.

BACKGROUND OF THE INVENTION

1. Field of the Invention

This invention relates generally to a magazine assembly for a fastener driving tool, and particularly to a side load magazine assembly having an elongated fastener carrier adapted to pivot about an axis parallel to the fastener feed path for loading fasteners into the tool.

2. Description of the Prior Art

Various types of magazine assemblies for fastener driving tools are known in the art. Known assemblies are difficult to reload when the fasteners in the magazine require replacement. While some attempts have been made to provide easily loaded magazine assemblies, these attempts have not succeeded because they have resulted in magazines that were extremely complex or that were not compact and easy to use.

For example, U.S. Pat. No. 3,946,927 to Fehrs discloses a magazine assembly for a fastener driving tool having a rigidly secured elongated rail for carrying fasteners in a fastener feed path. A pusher biases the fasteners toward the drive track. A slidingly mounted cover fits over the rail and closes the magazine assembly. In order to load fasteners into the magazine, the pusher is retracted and engages the cover to displace it in a direction transverse to the fastener feed path, thus exposing the elongated rail to allow fasteners to be loaded into the magazine assembly. Once the magazine assembly is loaded the cover is returned to a position over the elongated rail. However, with such a design, the magazine is stationary, thus requiring the fasteners to be loaded from the top and under the tool handle, which is relatively awkward.

U.S. Pat. No. 3,041,614 to D'Haem et al and Japanese Pat. No. 52-13182 disclose fastener driving tools having a rigidly secured elongated carrier defining a fastener feed path for carrying fasteners and the like. A spring loaded pusher is slidingly carried by the carrier to urge the fasteners forwardly. A top cover is provided to close the magazine assembly. The cover is pivotally mounted at one end about an axis transverse to the fastener feed path. In an operative position, the free end of the cover is securely latched directly over the elongated rail. The latch is released by retracting the pusher which unlatches the cover such that the cover will flip open under the influence of a spring. Since these prior art fastener driving tools also have a rigidly secured fastener carrier, fasteners must also be loaded onto the carrier from the top and under the tool handle which is relatively awkward.

Various other types of known magazine assemblies for fastener driving tools are disclosed in U.S. Pat. Nos. 4,624,401; 4,597,517; 3,905,535; 3,437,250, 1,634,840 and German Offenlegungschrift (OLS) 1 188 009. In general, the magazine assemblies disclosed in the prior art are awkward to operate. For example, the magazine assembly disclosed in the German OLS 1 188 009 is connected for pivotal movement about an axis parallel to the fastener drive path. To load fasteners into the tool, the magazine assembly must be swung out from the tool in a horizontal plane to expose the fastener carrier. Since the fastener driving tool is relatively heavy, such an operation is awkward and takes up a relatively large work space.

SUMMARY OF THE INVENTION

It is a general object of the present invention to provide a magazine assembly for a fastener driving tool which overcomes problems associated with conventional magazine assemblies.

It is another object of the present invention to provide a fastener driving tool with a magazine assembly that is easy to load with fasteners.

It is a further object to provide a magazine assembly for a fastener driving tool requiring a minimum of space.

Briefly, the present invention relates to a fastener driving tool having a magazine assembly including an elongated fastener carrier or rail defining a fastener feed path for carrying fasteners. The elongated carrier is pivotally mounted about an axis parallel to the fastener feed path to allow movement between an operative, refill and unjam position. The arrangement requires only a relatively small work space to reload fasteners when the magazine assembly is placed in a refill position. In the unjam position the nosepieces are spaced apart to facilitate unjamming of fasteners. The elongated fastener carrier is secured at one end to a nosepiece assembly defining a fastener drive track for guiding fasteners into a workpiece and is secured to the frame at the other end. A spring biased pusher, slidingly carried by the elongated fastener carrier, urges the fasteners forward toward the nosepiece for feeding the fasteners one at a time to the fastener drive track. The nosepiece assembly includes a front nosepiece and a rear nosepiece. The front nosepiece is fixed to the frame of the tool while the rear nosepiece is secured to the elongated fastener carrier for pivotal movement therewith. The front nosepiece and rear nosepiece define the fastener drive track and are pivotally connected together. A latch mechanism disposed in the forward portion of the tool secures the magazine assembly in an operative position. The latch mechanism can be released by retracting the pusher to allow the elongated carrier to pivot about an axis parallel to the fastener feed path to a refill position under the influence of a spring.

In an alternate embodiment, the latch mechanism is provided at the rear of the tool. A spring loaded pin having enlarged diameter portion or key on one end is slidingly received in a cover plate, rigidly secured to the rear of the elongated carrier. One end of the pin is slidingly disposed in the cover plate to allow axial movement of the pin in a direction relatively parallel with the fastener feed path. The other end of the pin extends outwardly from the cover plate and is received in an arcuate slot provided in an end plate forming a portion of the frame. One end of the slot is provided with a keyway for receiving the key portion of the pin to latch the elongated carrier in an operative position. When the elongated carrier is in the operative position, the key, under the influence of a spring, is received in the keyway to latch the assembly in an operative position. The latch mechanism is unlatched by pushing the pin inwardly such that the key is displaced from the keyway to allow a torsion spring, disposed at the rear pivot point of the tool, to bias the elongated carrier to pivot to the refill position.

Another important aspect of the present invention relates to the location of the pivot axis for the elongated carrier. In the alternate embodiment of the invention, the pivot axis is disposed generally parallel to the fastener feed path, offset from the drive track and located on the side of the drive track opposite the side of the magazine that opens. This arrangement permits a lesser clearance between the top of the tool cover and the top of the elongated carrier to allow a more compact tool.

Another important aspect of the invention relates to the latching of nosepieces in the operative position. The front and rear nosepieces are formed with interfitting portions to prevent separation of the nosepieces during operation.

DESCRIPTION OF THE DRAWING

These and other objects and advantages of the present invention will become readily apparent upon consideration of the following detailed description and attached drawing, wherein:

FIG. 1 is a side elevational view of a fastener driving tool embodying a magazine assembly in accordance with the present invention;

FIG. 2 is an enlarged fragmentary sectional view of the magazine assembly in an operative position taken along 2—2 in FIG. 1;

FIG. 3 is a sectional view of the nosepiece assembly taken along line 3—3 in FIG. 2;

FIG. 4 is a sectional view of the nosepiece assembly taken along line 4—4 in FIG. 2;

FIG. 8 is a sectional view of the magazine assembly taken along line 8—8 of FIG. 6;

FIG. 16 is a fragmentary sectional view of an alternative embodiment of the magazine assembly illustrated in FIG. 12, in accordance with the present invention;

FIG. 4 is a cross-sectional view of FIG. 20 along line 24—24;

FIG. 25 is a plan sectional view of FIG. 24 along line 25—25;

FIG. 26 is an exploded perspective view of portions of a nosepiece in accordance with the present invention;

FIG. 28 is a view similar to FIG. 24 showing the assembly in the refill position;

FIG. 29 is a view similar to FIG. 27 showing the assembly in unjam position;

FIG. 30 is a view similar to FIG. 24 showing the assembly in unjam position; and FIG. 31 is a plan sectional view of FIG. 29 along line 31—31 showing the nosepieces in the unjam position.

DETAILED DESCRIPTION

Figure 5:
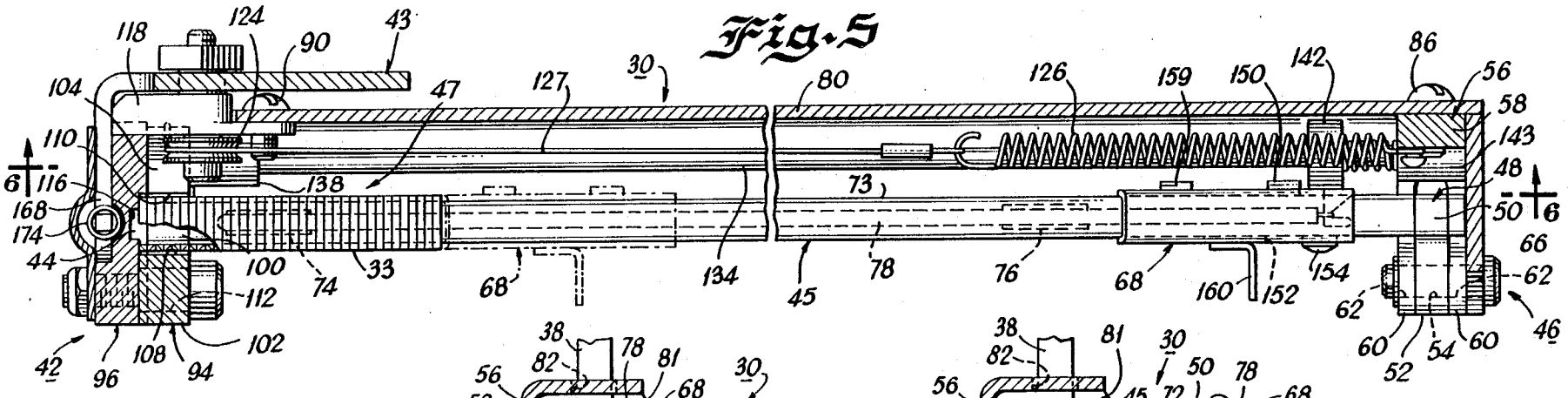
FIG. 5 is sectional view of the magazine assembly taken along line 5—5 of FIG. 1.

Referring to the drawing and particularly FIGS. 1–11, there is illustrated a magazine assembly for a fastener driving tool embodying the principles of the present invention. The magazine assembly, generally identified by the reference numeral 30, is adapted to carry a plurality of cohered or collated fastener 33 and feed them to a drive mechanism (not shown) having a reciprocally mounted driver blade or ram for driving the fasteners 33 into a workpiece. The illustrated embodiment of the invention is a magazine assembly for a pneumatically powered staple driving tool 31, but the specific type of drive mechanism and fastener type utilized are not critical to the practice of the present invention. Electric, pneumatic, hydraulic and other types of drive mechanisms and fasteners such as staples, nails, brads and others in cohered or loose collations could be used.

The fastener driving tool 31 includes a housing 32 having a handle portion 34 with one end joined proximate an end of a head portion 36. The other end of the handle portion 34 of the housing 32 is secured to a depending arm 38 located toward the rear of the fastener driving tool. The handle portion 34 has a fitting 39 for connection to a source of pressurized air. The head portion 36 of the housing 32 encloses a drive mechanism and is secured to a flange 40. The flange 40 is secured to or is a part of a nosepiece assembly 42. As will be discussed in detail below, the nosepiece assembly 42 defines a drive track 44 for receiving fasteners one at a time from the magazine assembly 30.

A conventional control system operates to drive a fastener along the drive track 44 and into a workpiece in response to activation of a manually operated trigger 41 and a workpiece engaging safety mechanism 43. Details of the tool 31 and its operation are unnecessary to an understanding of the present invention. U.S. Pat. No. 3,905,535, incorporated herein by reference, provides a more complete description of the tool 31.

Figures 9, 11, 12, 13:
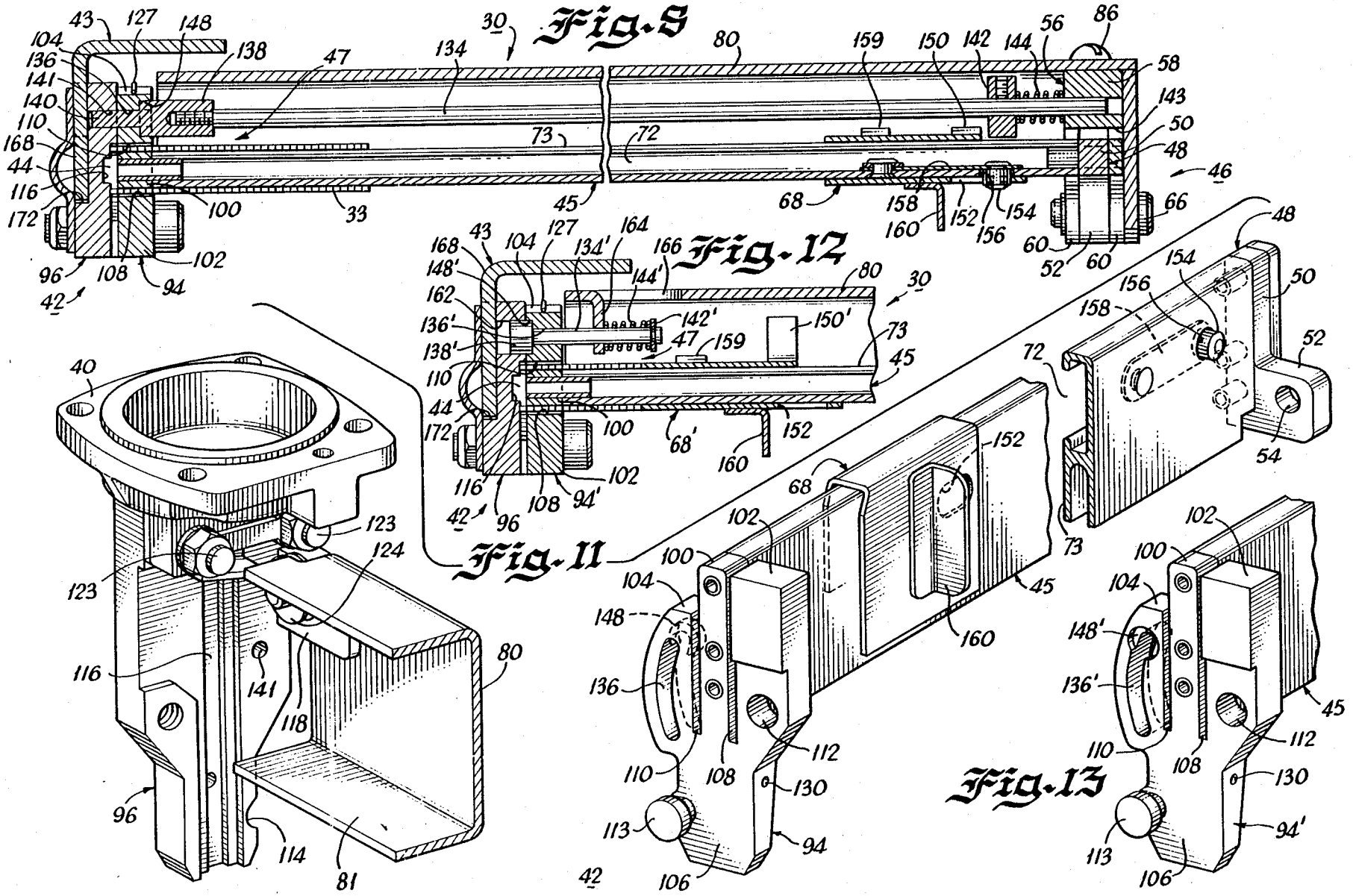
FIG. 9 is a view of the magazine assembly like FIG. 2 showing the refill position.
FIG. 11 is an exploded perspective view of a portion of the magazine assembly of the present invention.
FIG. 12 is a fragmentary sectional view of an alternative embodiment of the magazine assembly of the present invention.
FIG. 13 is a fragmentary perspective view of an alternative embodiment of the magazine assembly of the present invention.

As best shown in FIGS. 2 and 9, the magazine assembly 30 of the present invention includes structure pivotally mounted about an axis parallel to the fastener feed direction and parallel to the longitudinal axis of the magazine assembly for pivotal movement between operative position illustrated in FIG. 2 and a refill or fastener loading position as shown in FIG. 9. In the operative position, the magazine assembly 30 carries a plurality of fasteners and feeds them one at a time to the drive track 44 formed within the nosepiece assembly 42. In the refill position, the magazine assembly 30 is not in communication with the drive track 44 and fasteners 33 may easily and conveniently be loaded into, or removed from, the magazine assembly 30.

Although the magazine assembly 30 of the present invention is described as a device for carrying fasteners, such as staples, and feeding them one at a time to the drive track 44 formed in the nosepiece assembly 42, it is to be understood that the principles of the invention are applicable to other types of fasteners, such as nails, brads and the like. As shown in the drawing, an elongated rail 45 carries a plurality of cohered U-shaped staples. In embodiments utilizing other types of fasteners, such as nails, brads and the like, an appropriate fastener carrier is used in place of the rail 45.

The elongated rail 45 carries a plurality of fasteners and defines a fastener feed path 47 generally parallel to the longitudinal axis of the elongated rail 45. One end of the elongated rail 45 is pivotally connected to the rear of the tool by a rear support, generally identified by the reference numeral 46. The other end of the elongated rail 45 is carried by the nosepiece assembly 42 (as will be discussed in detail below) to allow pivotal movement of the elongated rail 45 about an axis parallel to its longitudinal axis.

The rear pivotal support 46 includes an L-shaped carrier bracket 48 with a vertical leg 50 and a horizontal leg 52. As best shown in FIG. 11, the vertical leg 50 has a generally rectangular cross-section and is rigidly secured to the end of the elongated rail 45. The horizontal leg 52 extends outwardly from the tool. An aperture 54 in the horizontal leg 52 defines an axis parallel to the longitudinal axis of the rail 45 for the rear support 46.

Figure 10:
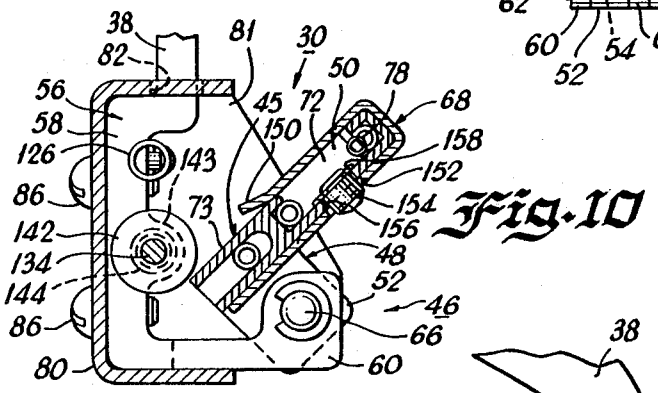
FIG. 10 is a sectional view of the rear portion like FIG. 7 showing the refill position.
Figure 7:
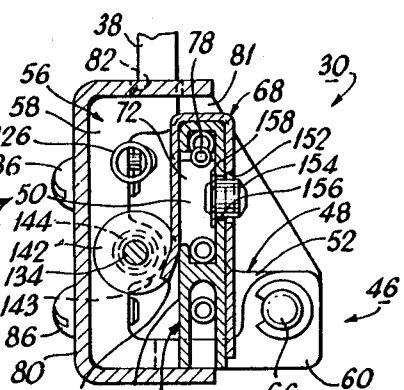
FIG. 7 is a sectional view of the rear portion of the magazine assembly in an operative position taken along line 7—7 of FIG. 1.

As best shown in FIGS. 7 and 10, a generally L-shaped bracket 56, which may be integrally formed with the depending arm 38, forms a portion of the tool frame and cooperates with the bracket 48 to form the rear pivotal support 46 for the the elongated rail 45. The bracket 56 includes a vertically oriented leg 58 and a pair of outwardly extending horizontal legs 60 which are spaced apart and generally oriented perpendicular to the vertically leg 58. The pair of outwardly extending legs 60 form a yoke having apertures 64 to receive the extending leg 52 of the carrier bracket 48 in an interfitting relationship such that the aperture 64 of the yoke is aligned with the aperture 54 of the extending leg 52 to receive a clevis pin 66 to form a clevis for providing the rear pivotal support for the elongated rail 45 about an axis parallel to the longitudinal axis of the elongated rail 45. The rear support 46 cooperates with the front support formed by the nosepiece assembly 42 as will be discussed in detail below.

In order to advance the fasteners along the elongated rail 45 toward the drive track 44 in the nosepiece assembly 42, a generally U-shaped pusher 68 is slidingly mounted on the elongated rail 45 for movement in a direction parallel to the longitudinal axis thereof. A biasing means may be employed to bias the pusher 68 toward the nosepiece assembly 42 for automatic advancement of the fasteners along the feedpath into the drive track 44. The biasing means for the pusher 68 includes a pair of pulleys 74 and 76 and a spring 78, disposed within a longitudinal cavity 72 on the inside wall 73 of the elongated rail 45 so as not to obstruct the travel of the pusher 68. The first pulley 74 is mounted within the cavity 72 toward the front of the elongated rail 45 while the second pulley 76 is mounted toward the rear. The pulleys 74 and 76 carry a spring 78 or other resilient member, such as bungee cord, having one end secured to the elongated rail 45 and the other end connected to the pusher 68 to bias the pusher toward the drive track 44.

A generally U-shaped magazine housing 80 is carried by the frame bracket 56. The magazine housing 80 includes an elongated U-shaped member which extends from the rear of the tool to the nosepiece assembly 42. The mouth 81 of the U-shaped member faces the longitudinal cavity 72 in the elongated rail 45 when the magazine assembly 30 is in an operative position. The elongated rail 45 is disposed intermediate the mouth 81 of the magazine housing 80 to form one wall of a four-sided enclosure for the magazine assembly 30 having a generally rectangular cross-section. A slot 82, may be disposed on the top at the rear of the magazine housing 80, allows the depending arm 38 to extend therethrough. Alternately, the depending arm 38 may be formed and attached to the side of the magazine housing 80.

The magazine housing 80 contains one or more apertures, disposed on the sides of the magazine housing 80, proximate the rear of the housing, for receiving machine screws 86 for fastening the magazine housing 80 into tapped holes in the bracket 56 to rigidly secure the magazine housing 80 thereto. One or more apertures are disposed in the front of the magazine housing 80 for receiving machine screws 90 for rigidly securing the front of the magazine housing 80 to the nosepiece assembly 42.

The nosepiece assembly 42 disposed at the front of the tool, is adapted to engage a workpiece and provide a drive track 44 for guiding the fasteners therethrough and into a workpiece. The nosepiece assembly 42 includes a rear nosepiece 94 and a front nosepiece 96 which are pivotally connected together to allow scissor-like movement between an operate position in which the forward member 96 and the rear member 94 cooperatively define a drive track 44 for the fasteners and a release position wherein the bottom portion of the drive track 44 is exposed to facilitate removal of fasteners which may become jammed therein.

The rear nosepiece portion 94 comprises three generally vertically extending legs 100, 102, 104 joined at one end to a shank 106. The legs 100, 102 and 104 are spaced apart and define a pair of slots 108 and 110 disposed between the center leg 100 and the leg 102 and between the center leg 100 and the leg 104, respectively. The distance between the slots 108 and 110 is sufficient to carry fasteners such that the fasteners can advance from the elongated rail 45 into the drive track 44. The center leg 100 of the rear nosepiece 94 has the same contour as the the elongated rail 45 and forms a portion of the fastener feed path. The outer leg 102 contains an aperture 112 which is axially aligned with the aperture 54 in the L-shaped bracket 52 to define an axis for pivotal movement of the elongated rail 45 about an axis parallel to its longitudinal axis.

Fasteners being driven into relatively dense material have a tendency to buckle within the drive track 44 if there is movement of the front nosepiece 96' with respect to the rear nosepiece 94' during operation. This can result in partially driven or poorly driven fasteners. A nosepiece latch is provided to prevent this problem. The nosepiece latch secures the nosepieces 96' and 94' together during operation.

The rear nosepiece 94 and the front nosepiece 96 are formed with interlocking latch portions 113 and 114, respectively, to latch the respective nose-pieces together in an operative portion. The latch portions 113 and 114 are disposed adjacent the drive track 44 on the side opposite the pivot axis of the elongated rail 45. The nosepiece latch prevents the nosepieces 94 and 96 from separating during operation which can result in a poorly or only partially driven fasteners 33.

The nosepiece latch portion 114 may be formed as a notch in the front nosepiece 96 for receiving an interlocking or interfitting portion 113 carried by the rear nosepiece 94. The interlocking portion may be formed as a pin 217 extending outwardly and rigidly connected at one end to the rear nosepiece 94 in a direction perpendicular the plane of the drive track 44. An increased diameter portion 219 forming a disc is disposed at the end of pin 217. The increased diameter portion 219 is received in the notch 114 to secure the nosepieces 94 and 96 together in the operative position.

The latch portions 113 and 114 may also be used to restrict pivotal travel of the elongated rail 45 if other means, such as the slot 136 are not provided. In such a case, travel to the release position would be restricted when the portion 113 engages the notch 114.

The front nosepiece 96 has the same general contour as the rear nosepiece 94. A vertical slot 116 is disposed in the front nosepiece member and cooperates with the inner wall surface of the rear nosepiece 94 to define a drive track 44 for receiving fasteners from the elongated rail 45. The drive track 44 is adapted to receive a reciprocally mounted driver blade or ram for driving the fastener through the drive track 44 and into a workpiece. A plate 118 mounted or integrally formed to extend perpendicular to the inner wall surface of the front nosepiece member 96 is used for connecting the front portion of the magazine housing 80 to the front nosepiece 96 by way of the machine screw 90 received in a tapped opening in the plate 118. Apertures 122, disposed in the front and near the top of the front nosepiece 96 receive machine screws 123 for rigidly fastening the front nosepiece 96 to the flange 40.

Figure 6:
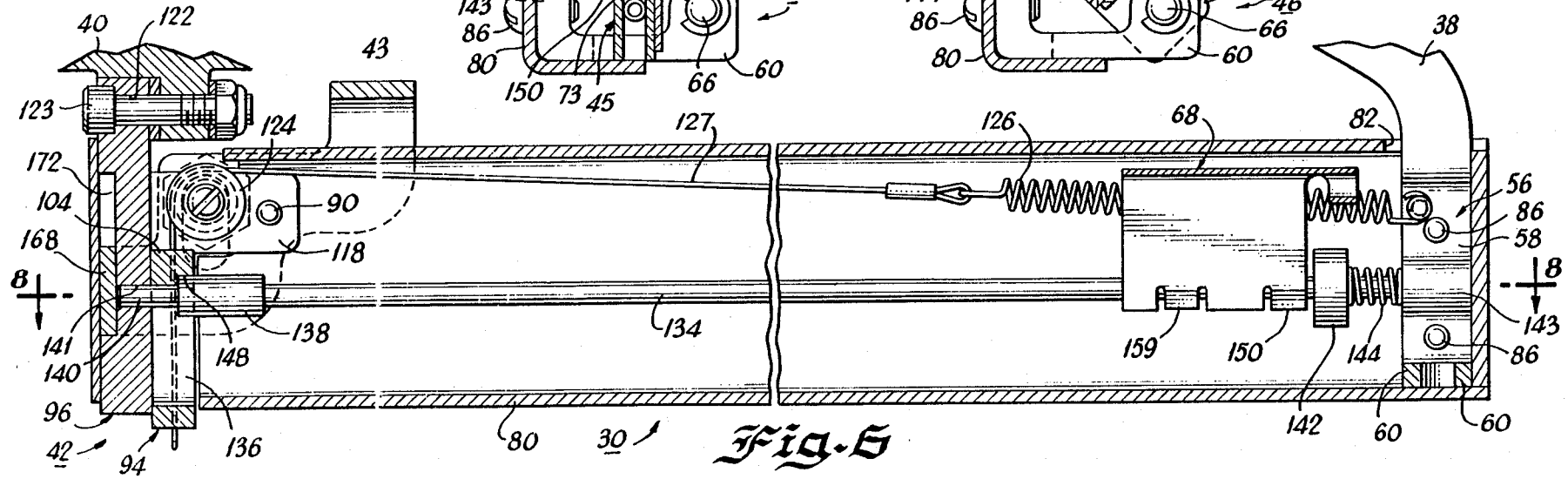
FIG. 6 is a sectional view of the magazine assembly taken along line 6—6 of FIG. 5.

Means are provided to bias the magazine assembly 30 and the nosepiece assembly 42 toward the refill position. Specifically, a pulley 124 is rotatably connected to the inside of the plate 118 for carrying an extension spring 126 secured at one end to the L-shaped frame bracket 56. As best shown in FIGS. 3 and 6, the extension spring 126 is connected to a cable 127 extending over pulley 124 and fed through a transverse bore 130 at the bottom of the rear nosepiece 94 and is secured thereto. The elongated rail 45 and rigidly attached rear nosepiece member 94 are thus biased toward a refill position.

In order to latch the magazine assembly 30 in an operative position, an elongated pull rod 134 is disposed within the magazine housing 80 and cooperates with an arcuate slot 136 in the outward leg 104 of the rear nosepiece 94. The pull rod 134 is mounted for axial movement between a latch position for latching the magazine assembly 30 in an operative position and a release position for releasing the magazine assembly 30 once latched. Specifically, the pull rod 134 is an elongated rod having an enlarged diameter portion 138 near one end of the pull rod 134 defining an extending end portion 140 between the end of the pull rod 134 and the enlarged diameter portion 138. The end portion 140 is guided by an opening 141 in the front nosepiece 96. A collar 142 is disposed proximate the other end of the pull rod 134.

The collar end of the elongated pull rod 134 is mounted in a boss 143 formed in the vertical leg 58 of the L-shaped frame bracket 56 for reciprocal axial movement. A spring 144, disposed on the pull rod 134 between the boss 143 and the collar 142, biases the pull rod 134 toward the front of the tool. When the magazine assembly 30 is pivoted such that the enlarged diameter portion or keyhole 148 of the arcuate slot 136 formed in the rear nosepiece 94 is axially aligned with the enlarged diameter portion 138 of the pull rod 134, the pull rod 134 is biased forward such that enlarged diameter portion 138 of the pull rod 134 is received into the keyhole 148 to latch the elongated rail 45 in an operative position. To release the elongated rail 45 once latched, the pull rod 134 must be axially moved toward the rear of the tool enough to withdraw the enlarged diameter portion 138 of the pull rod 134 from the keyhole 148. As soon as the enlarged portion 138 of the pull rod 134 disengages from the keyhole 148, the elongated rail 45 moves toward the refill position under the influence of the extension spring 126. Also, as the enlarged portion 138 of the pull rod 134 disengages the keyhole 148, the extending end portion 140 of the pull rod 134 is guided along the arcuate slot 136 by the opening 140.

In order to advance the pull rod 134 to release the elongated rail 45 once latched, the collar 142 is displaced rearwardly. An outwardly extending tab 150 disposed on the inside wall of the pusher 68 engages the collar 142 when the pusher 68 is retracted to the refill position as shown in FIG. 8. A slot 152 on the outside wall of the pusher 68 receives a bullet pin 154 resiliently protruding outwardly through an aperture 156 in the wall of the elongated rail 45. The bullet pin 154 is secured to a resilient member or leaf spring 158 which, in turn, is rigidly secured to the interior wall of the elongated rail 45 within the rail cavity 72. By depressing the bullet pin 154 to cause it to be flush with the exterior wall of the elongated rail 45, the pusher 68 can be moved rearwardly over the bullet pin 154 until the slot 152 passes directly over the bullet pin 154 at which point the bullet pin 154 is biased forward such that it protrudes from the exterior surface of the elongated rail 45 and is captured within the horizontally oriented slot 152. A bracket, such as an L-shaped bracket 160, may be disposed on the exterior wall of the pusher 68 to facilitate grasping the pusher 68 and advancing it rearwardly to unlatch the elongated rail 45.

The position of the slot 152 with respect to the tab 150 disposed on an interior sidewall of the pusher 68 defines two positions for the pusher 68 while the bullet pin 154 is captured within the slot 152. In the rearmost position of the pusher 68, the tab 150 engages the collar 142 to displace the pull rod 134 axially in a rearward direction to unlatch magazine assembly 30. Specifically, as the pull rod 134 is moved rearwardly the enlarged portion 138 of the pull rod 134 becomes disengaged from the keyhole 148 to unlatch the elongated rail 45. Once the elongated rail 45 is unlatched, it pivots outwardly under the influence of the spring force from the extension spring 126 to bias the magazine to the refill position until the slot 136 engages the end 140 of the pull rod 134. As the pusher 68 is released, the pusher biasing means 78 advances the pusher 68 in a forward direction until the bullet pin 154 engages the rear arc of the slot 152 as shown in FIG. 1. In this position, the tab 150 on the pusher 68 does not engage the collar 142 disposed on the pull rod 134. However, the pusher 68 is held retracted to allow fasteners to be loaded into the tool. Once the fasteners have been loaded, the bullet pin 154 is depressed to release the pusher 68 and allow the pusher 68 to be biased forwardly to bias the fasteners toward the drive track 44. Another tab 159, outwardly extending and disposed on the interior wall of the pusher 68, restricts travel of the pusher 68 in the forward direction. Specifically, the tab 159 engages the rear nosepiece 94 at the limit of forward travel.

The safety mechanism 43 includes a safety yoke 168, slidingly carried by the front nosepiece 96, reduces inadvertant operation of the tool. The safety yoke 168 includes an extending shank 170 received in a vertical cavity 172 formed in the front nosepiece 96. The safety yoke 168 is biased by a spring 174 to cause the shank 170 to extend downward below the nosepiece assembly 42. While the safety yoke 168 is extending downward below the nosepiece assembly 42, the trigger 41 cannot operate the tool. When a downward force is applied to the tool sufficient to overcome the force of the spring 174, the nosepiece assembly 42 engages the workpiece causing the shank 170 to be drawn into the front nosepiece cavity 172 to an operative position cooperating with the trigger 41 permitting operation of the tool and allowing fasteners to be driven into the workpiece.

FIGS. 12, 13 and 16 illustrate an alternative embodiment for the latch release mechanism previously described. For clarity, elements identical to those described and illustrated in FIGS. 1–11 are identified by the same reference numeral while primes and double primes will be used to distinguish nonidentical elements having a similar function.

Referring to FIGS. 12 and 13, a modified pull rod 134' is provided which extends through an arcuate slot 136' in the rear nosepiece 94' and is reciprocally carried by a frame member 164 for axial movement. A collar 142' is disposed proximate the end of the modified pull rod 134' for engaging a tab 150' on the pusher 68. A spring 144' is disposed along the axis of the pull rod 134' between the frame member 164 and the collar 142' to bias the pull rod 134' rearwardly. The pull rod 134' extends through the arcuate slot 136' in the rear nosepiece 94' such that the enlarged diameter portion 138' of the pull rod 134' is disposed in a cavity 162. The rear wall surface of the enlarged diameter portion 138' of the pull rod 134' engages the front wall of the rear nosepiece 94' to allow the elongated rail 134' to pivot about an axis parallel to its longitudinal axis. When the enlarged diameter portion 138' becomes axially aligned with the keyhole 148', the spring 144' urges the pull rod 134' rearwardly to latch the magazine assembly in an operative position. A tab 150', extending outwardly from the inside wall of the pusher 68', engages the collar 142' and advances the pull rod 134' axially in a direction toward the nosepiece assembly 42 to allow the enlarged diameter portion 138' of the pull rod 134' to be received in a cavity 162 to unlatch the magazine assembly and allow it to freely pivot. In operation, when the last fastener is advanced into the drive track 44, the magazine assembly 30 is automatically unlatched allowing the elongated rail 45 to pivot to the reload position. An opening 166 is provided on the side of the magazine housing 80 to allow access to the collar 142' and pull rod 134' such that the magazine assembly 30 can be unlatched before the last fastener is discharged from the tool to allow the magazine assembly to be unlatched any time when one or more fasteners become jammed.

Figure 14:
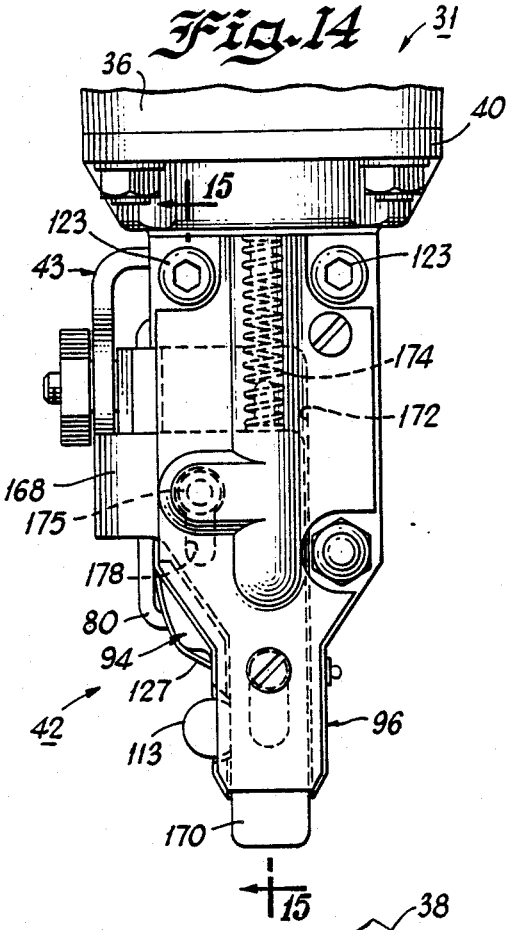
FIG. 14 is a fragmentary elevational view of an alterative embodiment of the magazine assembly of the present invention.
Figure 15:
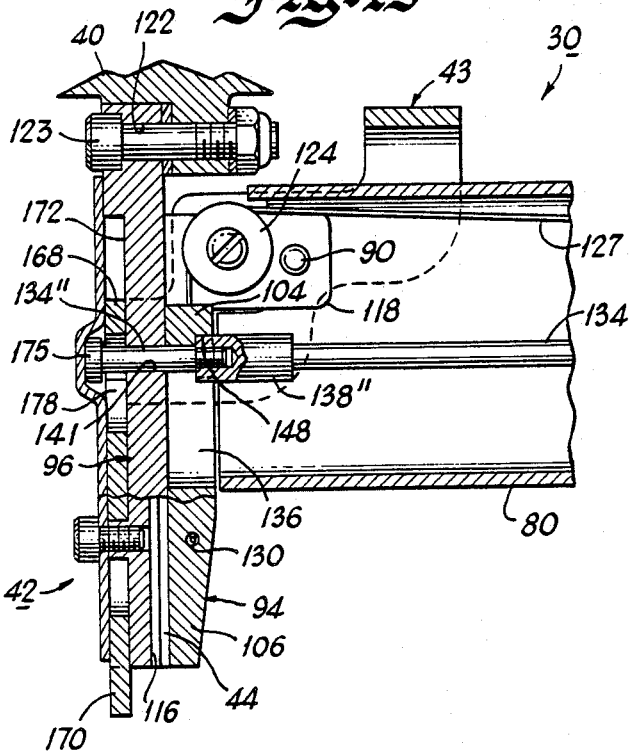
FIG. 15 is a fragmentary sectional view of an alternative embodiment of the magazine assembly illustrated in FIG. 7, in accordance with the present invention.

Another important aspect of the invention is illustrated in FIGS. 14, 15 and 16. As shown in FIGS. 14 and 15, the safety yoke 168 is interlocked with the pull rod 134" to latch the safety yoke 168 in an inoperative position whenever the magazine assembly 30 is unlatched. FIG. 16 illustrates an alternative safety yoke interlock for the tool illustrated in FIGS. 12 and 13. More specifically referring to FIGS. 14 and 15, an alternative pull rod 134" is disclosed having an additional enlarged diameter portion 175 axially spaced from the enlarged diameter portion 138" of the pull rod 134". A keyhole slot 178 is disposed in the safety yoke 168, axially aligned with the pull rod 134" to latch the safety yoke 168 in an inoperative position whenever the magazine assembly 30 is unlatched. In the embodiment illustrated in FIG. 16, the safety yoke 168 contains an aperture 180, rather than a keyhole slot, axially aligned with the pull rod 134", which also latches the safety yoke 168 in an inoperative position whenever the magazine assembly 30 is unlatched.

In operation, fasteners, such as staples and the like, are loaded into the magazine assembly 30 by depressing the bullet pin 154 and retracting the pusher 68 until the bullet pin 154 is captured within the slot 152. By continuing to retract the pusher 68 until the bullet pin 154 engages the forward arc of the slot 152, a tab 150, disposed on the interior sidewall of the pusher 68, engages a collar 142 on the pull rod 134 and displaces the pull rod 134 axially in a rearward direction which, in turn, disengages the enlarged diameter portion 138 of the pull rod 134 from a keyhole 148 disposed within the rear nosepiece 94. Once the enlarged diameter portion 138 of the pull rod 134 is disengaged from the keyhole 148, the elongated rail 45 pivots about an axis parallel to its longitudinal axis to allow the magazine assembly 30 to be reloaded with fasteners. Once the fasteners are loaded, the bullet pin 154 is depressed to allow the pusher 68 to slide forward to engage the fasteners and bias them toward the drive track 44 formed in the nosepiece assembly 42 until the last fastener in the magazine is used, at which time, the magazine assembly 30 can be reloaded in the manner described above. During operation of the tool the drive track 44, formed in the nosepiece assembly 42 can be exposed at any time to unjam fasteners.

In FIGS. 1–18, the pivot axis 200 for the elongated carrier 45 is disposed parallel to the fastener feed track 47 offset from the drive track 44, adjacent the side 202 of the magazine 30 which opens. FIGS. 19–31 illustrate an alternate embodiment wherein the pivot axis 200 is disposed on the opposite side 204 of the magazine 30. By disposing the pivot axis on the side 204, there is less clearance between the top 205 of the elongated carrier 45 and the cover 80. This reduced clearance between the top of the tool cover 80 and elongated carrier 45 prevents the fasteners 33 from moving upwardly to allow for more precise driving of the fasteners 33. Also, this allows the tool to be made more compact.

In the alternate embodiment, the L-shaped bracket 48, connected to the rear of the elongated carrier 45, is replaced with a modified L-shaped bracket 48'. This bracket 48' is provided with a horizontal leg 50' and a vertical leg 52'. The horizontal leg 52' is disposed to extend outwardly toward the side 204 of the tool. An aperture 54', disposed in the horizontal leg 50', defines a rear pivot point for the elongated carrier 45. A rear cover plate 206 forming a portion of the tool frame is rigidly connected to the depending arm 38 and the magazine cover 80. An aperture 208 in the rear cover plate 206 is aligned with the aperture 54' in the bracket 48'. A shoulder screw 210 is received in the apertures 54' and 208 to define a rear pivot axis 200. A torsion spring 212 is disposed about the shoulder pin 210 to bias the elongated carrier 45 outwardly toward the refill position any time the elongated carrier 45 is unlatched. In this alternate embodiment, the torsion spring 212 replaces the pulley 124, the spring 126 and the cable 127.

The latch mechanism in the alternate embodiment is also modified from that illustrated in FIGS. 1–18. In general, rather than latching the elongated carrier 45 in the front portion of the tool as in FIGS. 1–18, the elongated carrier 45 is latched in the rear portion of the tool. This eliminates the need for the pull rod 134 and the need for the arcuate slot formed in the leg 104 of the rear nosepiece 94. In this embodiment, the end plate 206 is formed with an arcuate slot 214 with a keyway 216 disposed at one end corresponding to the operative position of the magazine. A latch pin 218 is disposed in an aperture 220 provided in the bracket 48' to allow axial movement of the latch pin 218. A spring 222 biases the latch pin 218 outwardly. The latch pin 218 is provided with an increased diameter portion or key 224 at one end, adapted to be received in the keyway 216 to latch the magazine 30 in an operative position. To unlatch the magazine, the end 228 of the latch pin 218, which extends outwardly through the arcuate slot 216 in the cover end plate 206, is pushed to displace it axially inwardly from the keyway 216. The inside portion of the latching pin 218 is received in a boss 220 disposed in the elongated carrier 45. Once the key 224 is removed from the keyway 216, the elongated carrier 45 is urged toward the refill position by the torsion spring 212. The end 228 of the latch pin 218 then rides freely in the arcuate slot 214.

As a result of providing the pivot axis 200 on the side 204 of the tool, opposite the side of the magazine 30 which opens and providing a latch mechanism in the rear of the tool, modified front and rear nosepieces 96" and 94" are provided. More specifically, since the elongated carrier 45 is latched in the rear of the tool, the arcuate slot 136 in the leg 104 in the first described embodiment is not required. Also the aperture 112 in the rear nosepiece 94 in the leg 102 is also not required because of the relocation of the pivot axis to the side 104.

In his alternate embodiment, the rear nosepiece 94" is provided with three spaced apart legs 100', 102' and 104'. The center leg 100' is rigidly affixed to the elongated carrier 45 forming a portion of the fastener feed track. The leg 102' is a generally rectangular member, similar to the leg 100'. The leg 104' is relatively shorter and is formed with an aperture 230. The aperture 230 is aligned with an aperture 232 in the front nosepiece 96" forming a front pivotal support for the combination elongated carrier 45 and the rear nosepiece 94". The apertures 230 and 232 are aligned along the pivot axis 200. A shoulder screw 233 is received in the apertures 230 and 232 to provide a pivotal connection.

In the alternate embodiment, the nosepieces 94" and 96" are latched on both sides 202 and 204. On side 204, the front and rear nosepieces 94" and 96" are provided with interfitting portions 234 and 236 which act as a key and a keyway to secure the two piece nosepiece 94", 96" together to prevent fasteners 33 from being misaligned in the drive track 44 during operation. The interfitting portions 234 and 236 are integrally formed with the front nosepiece 96" and rear nosepiece 94", respectively.

The interfitting portion 234 is formed with a boss 238 having a groove 240 disposed parallel to the longitudinal axis of the rear nosepiece 94" forming a keyway. A complementary key 242 formed in the front nosepiece 96" is received and captured in the groove 240 in an operative position to secure the nosepieces 96" and 94" together.

The other side 202 of the nosepieces 96" and 94" are also latched and provided with interfitting portions 244 and 246, respectively, forming, for example, a dovetail connection. Specifically, a protuberance 244 is provided on the front nosepiece 96". This protuberance 244 is received in a slot 246 integrally formed on the rear nosepiece 94" when the nosepieces 96" and 94" are in an operative position. Thus, the nosepieces 96" and 94" are latched on each side of the drive track 44.

When the magazine 30 is in the refill position, the interfitting portions 244 and 246 are separated. This allows the nosepieces 96" and 94" to be separated and the magazine 30 to be pivoted an additional amount to an unjam position. The additional amount of travel is limited by the arcuate slot 214 in the end plate 206. However, before the magazine can be pivoted to the unjam position, it is necessary that complementary shoulders 248 and 250, disposed on the inner surfaces 252 of the front and rear nosepieces 96" and 94", be separated. This is accomplished by moving the elongated carrier 45 axially rearwardly until the complementary shoulders 248 and 250 are separated. Once the complementary shoulders 248 and 250 are separated, the elongated carrier 45 will automatically pivot to the unjam position under the influence of the torsion spring 212. The jammed fasteners can then be removed.

In order to prevent the magazine 30 from being closed while the nosepieces 96" and 94" are spaced apart, a stop pin 251 is provided in the end plate 206. This pin 251 acts as a stop to prevent the magazine 30 from being closed while the nosepieces 96" and 94" are axially separated. In order to return to an operative position, it is necessary to move the elongated carrier axially forwardly closing the nosepieces 96" and 94". This allows the bracket 48', affixed to the rearward end of the carrier 45, to clear the pin 251 to allow the carrier 45 to be placed in the operative position.

Another important aspect of the alternate embodiment is the configuration of the safety yoke 170'. In this configuration, the engaging surface of the safety yoke 170' is formed in a C-shape. This configuration provides more stability when fasteners are being driven near an edge of the workpiece.

The extending tabs 253, integrally formed on the ends 254 of the engaging surface, prevent the nosepieces 96" and 94" from separating during operation. As best shown in FIG. 29, the tabs 253 also engage the rear nosepiece 94" when the elongated rail 45' is not in the operative position to prevent the safety yoke 170' from being retracted. This prevents the tool from being operated in this condition.

Figure 17:
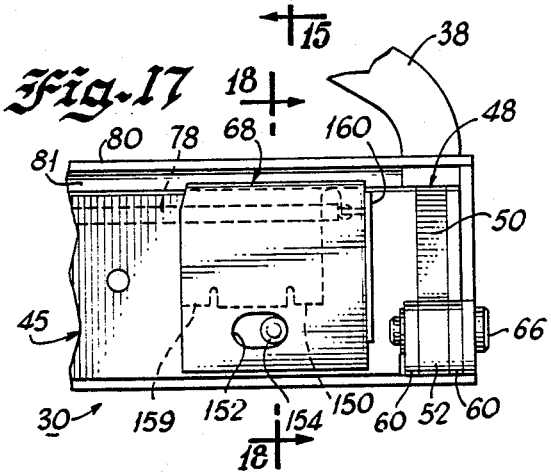
FIG. 17 is a partial plan view of an alternative embodiment of the present invention.
Figure 18:
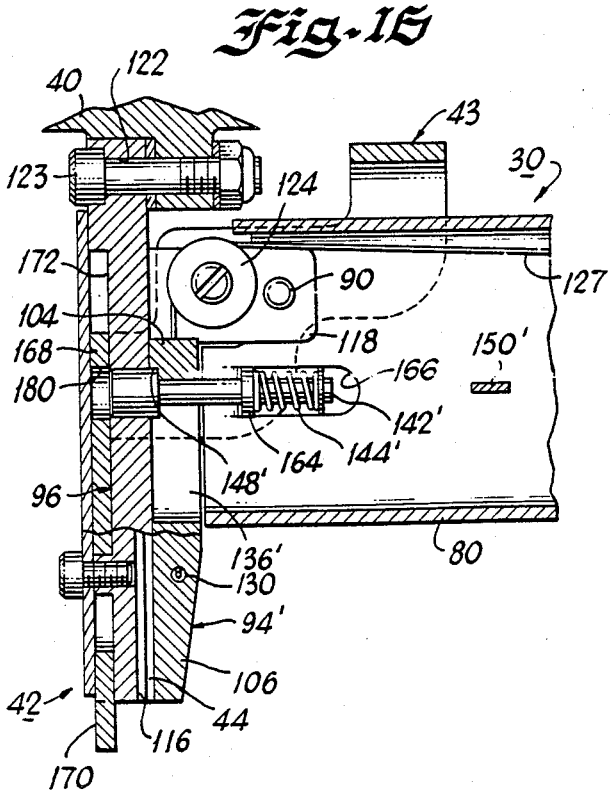
FIG. 18 is a sectional view of the magazine assembly taken along line 18—18 of FIG. 17.
Figure 19:
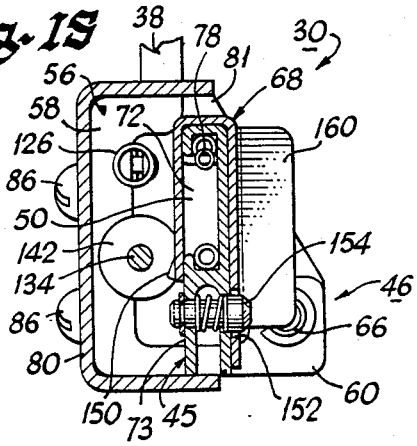
FIG. 19 is a side elevational view of an alternate embodiment of the fastener driving tool in accordance with the present invention.
Figure 19:
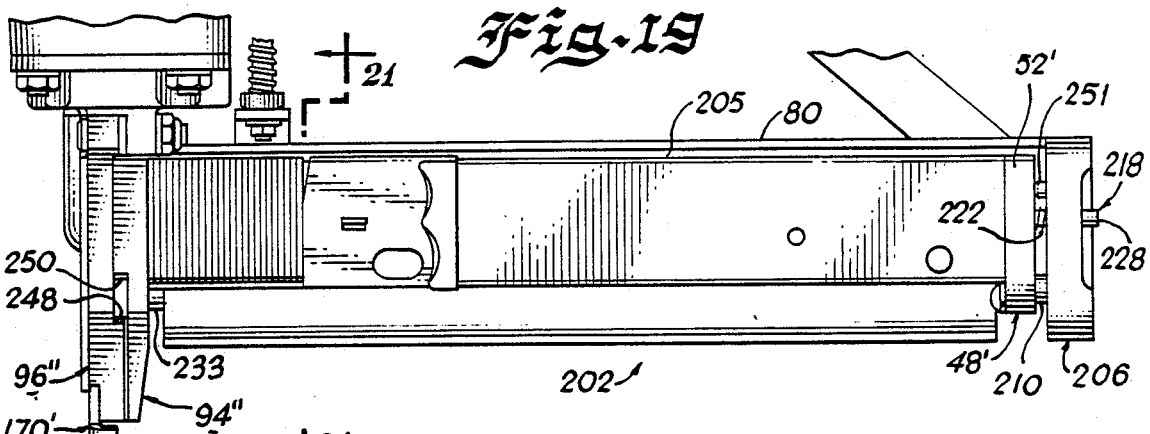
Figure 20:
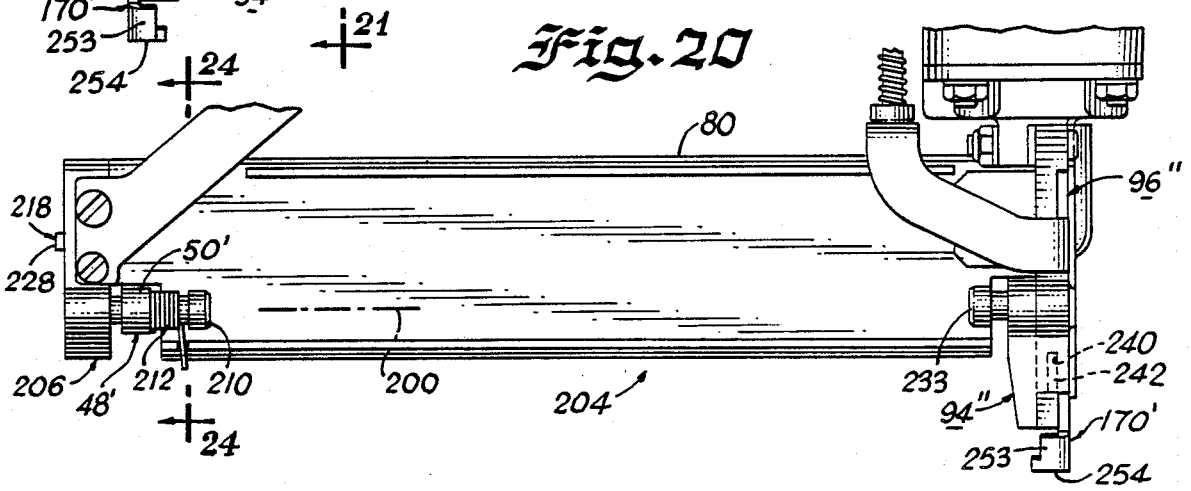
FIG. 20 is similar to FIG. 19 except it illustrates the opposite side of the fastener driving tool.
Figure 21:
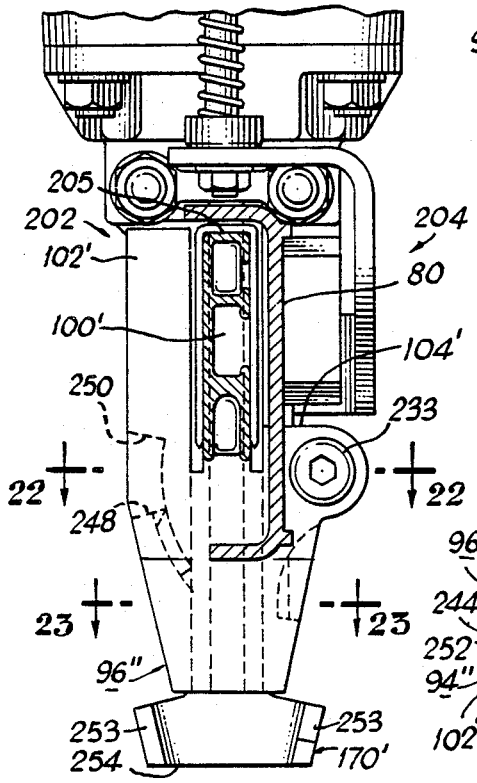
FIG. 21 is a cross-sectional view of FIG. 19 along line 21—21.
Figure 23:
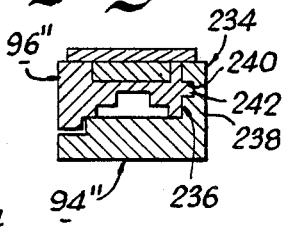
FIG. 23 is a plan sectional view of FIG. 21 along line 23—23.
Figure 22:
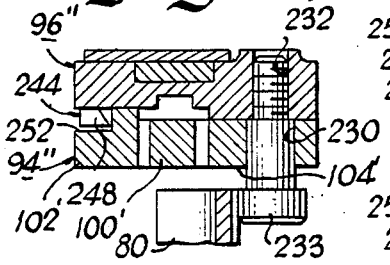
FIG. 22 is a plan sectional view of FIG. 21 line 22—22.
Figure 27:
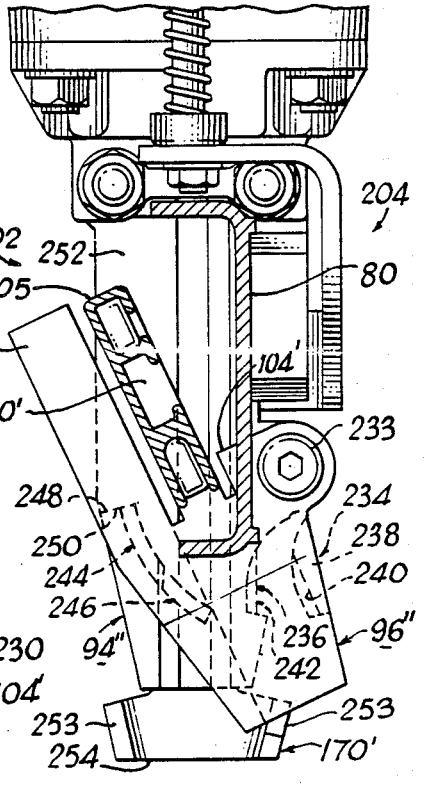
FIG. 27 is similar to FIG. 21 showing the nosepiece/-carrier assembly in the refill position.

Thus, it should be apparent that a unique magazine assembly for a fastener driving tool has been disclosed for facilitating loading and reloading of fasteners into the magazine which requires substantially less work space in the refill position than conventional magazine assemblies. The system can be implemented in a number of ways. For example, FIG. 17 illustrates an alternative embodiment for the pusher 68 showing the handle bracket 160 disposed generally perpendicular to the longitudinal axis of the magazine assembly. FIG. 18 shows another alternative embodiment wherein the bullet pin 154 is biased with a coil spring 158' instead of the leaf spring 158. FIGS. 19–31 also show other embodiments. All such embodiments are contemplated to be within the scope of the appended claims.

What is claimed and desired to be secured by a Letters Patent of the United States is:

1. A fastener driving tool for driving fasteners into a workpiece comprising:

a housing;

a front nosepiece secured to the housing;

a support means secured to the housing spaced from the front nosepiece;

a back nosepiece cooperating with the front nosepiece to define a drive track;

an elongated fastener carrier secured to the back nosepiece for feeding fasteners into the drive track;

first pivot means pivotally mounting the back nosepiece on the front nosepiece for arcuate movement about a given axis offset to one side of the drive track; and second pivot means pivotally mounting the elongated fastener carrier to the support means for arcuate movement about said given axis so that the front nosepiece and said fastener carrier pivot together about said given axis.

2. The fastener driving tool set forth in claim 1 in which the elongated fastener carrier pivots between a refill position and an operating position, and which includes means for interlocking the front and back nosepieces, movable into engagement in the operative position and out of engagement in the refill position.

3. The fastener driving tool set forth in claim 2 in which said interlocking means are located on said front and back nosepieces on the opposite side of the drive track from said given axis.

4. A magazine assembly carried by a tool frame for feeding fasteners into a drive track of a fastener driving tool comprising:

a nosepiece assembly defining said drive track including a front nosepiece and a rear nosepiece pivotally connected together, said front nosepiece coupled to said tool frame;

an elongated carrier coupled to said rear nosepiece to be in communication with said drive track;

means for pivotally supporting said rear nosepiece and said elongated carrier about an axis parallel to the longitudinal axis of said elongated carrier for movement between an operative position, a refill position and an unjam position; and means for feeding the fasteners one at a time into the drive track.

5. A magazine assembly as recited in claim 4 further including means for spacing apart said nosepieces in said unjam position.

6. A magazine assembly carried by a tool frame for feeding fasteners into a drive track of a fastener driving tool having a first side and a second side comprising:

an elongated carrier disposed to be in communication with said drive track for carrying fasteners;

means for pivotally supporting said elongated carrier about an axis parallel to the longitudinal axis of said elongated carrier, offset from said drive track for movement between an operative position and a refill position to allow fasteners to be loaded from the first side of the tool; and means for feeding fasteners one at a time into the drive track.

7. A magazine assembly as recited in claim 6, wherein said pivotally supporting means is disposed on said second side of said elongated carrier.

8. A magazine assembly as recited in claim 6 further including means for allowing said elongated carrier to also pivot to an unjam position.

9. A fastener driving tool for driving fasteners into a workpiece comprising:

a housing;

a nosepiece assembly carried by said housing including a front nosepiece and a rear nosepiece pivotally connected together to form a drive track for movement between a first position and a second position;

a fastener carrier in communication with said drive track for driving fasteners into the workpiece;

means for advancing the fasteners toward said drive track; and means for latching said front and rear nosepieces together in said first position.

10. A fastener driving tool as recited in claim 9 wherein said latching means includes a first set of interfitting portions integrally formed in said front and rear nosepieces which latch said nosepieces together in said first position.

11. A fastener driving tool as recited in claim 10 wherein said first set of interfitting parts are disposed offset to one side of said drive track.

12. A fastener driving tool as recited in claim 11 further including a second set of interfitting portions integrally formed in said front and rear nosepieces for latching said nosepieces together in said first position.

13. A fastener driving tool as recited in claim 12 wherein said second set of interfitting portions is disposed on the side opposite said one side of said drive track.

14. A fastener driving tool as recited in claim 13 wherein said first set of interfitting portions include a key and a keyway.

15. A fastener driving tool as recited in claim 12 wherein said second set of interfitting portions forms a dovetail connection.

16. A fastener driving tool as recited in claim 9 further including means for preventing said nosepieces from pivoting in said first position.

17. A fastener driving tool as recited in claim 9 further including means for allowing said nosepieces to pivot to a third position.

18. A fastener driving tool as recited in claim 17 further including means for spacing apart said nosepieces in said third position.

19. A fastener driving tool as recited in claim 17 further including means for preventing movement to said first position if said nosepieces are spaced apart.

20. A fastener driving tool as recited in claim 9 further including means for preventing operation of the tool when said nosepieces are not in said first position.

* * * * *